US005250008A

United States Patent [19]

Lange

[11] Patent Number: 5,250,008

[45] Date of Patent: Oct. 5, 1993

[54] APPARATUS FOR MAKING AND CONVEYING ELONGATED HEADED WIRE WORKPIECES

[75] Inventor: Gerhard Lange, Reutlingen, Fed. Rep. of Germany

[73] Assignee: WAFIOS Maschinenfabrik GmbH & Co., Fed. Rep. of Germany

[21] Appl. No.: 821,174

[22] Filed: Jan. 16, 1992

Related U.S. Application Data

[63] Continuation of Ser. No. 535,060, Jun. 8, 1990, abandoned.

[30] Foreign Application Priority Data

Jul. 8, 1989 [DE] Fed. Rep. of Germany ..... 3922530

[51] Int. Cl.[5] ..... B21G 3/32

[52] U.S. Cl. ..... 470/177; 470/164; 470/168; 72/422; 198/626.1; 198/456; 198/345.1

[58] Field of Search ..... 198/345.1, 456, 597, 198/598, 626.1, 626.5, 690.2; 72/420, 421, 422, 423; 470/128, 177, 179, 164, 168, 175, 129, 135, 121

[56] References Cited

U.S. PATENT DOCUMENTS

| | | | |
|---|---|---|---|
| 3,007,181 | 11/1961 | Felber | 470/177 |
| 3,108,682 | 10/1963 | Zipper | 198/626.1 |
| 3,183,533 | 5/1965 | Kull | 470/164 |
| 3,301,033 | 1/1967 | Bignell et al. | 470/125 |
| 3,604,034 | 9/1971 | Leistner | 470/125 |
| 3,853,016 | 12/1974 | Lane, III et al. | 198/626.1 |
| 4,270,651 | 6/1981 | Ragard et al. | 198/456 |
| 4,493,233 | 1/1985 | Dusel et al. | 198/626.5 |
| 4,546,526 | 10/1985 | Dusel et al. | 198/626.5 |
| 4,650,060 | 3/1987 | Storimens | 198/459 |
| 4,737,227 | 4/1988 | Foster et al. | 156/297 |

FOREIGN PATENT DOCUMENTS

| | | | |
|---|---|---|---|
| 0772341 | 11/1967 | Canada | 470/125 |
| 49164 | 10/1889 | Fed. Rep. of Germany . | |
| 41141 | 10/1965 | Fed. Rep. of Germany . | |
| 3143269 | 5/1983 | Fed. Rep. of Germany . | |
| 2285317 | 4/1976 | France . | |

OTHER PUBLICATIONS

JP-A-60-188205, Nakamura, Storage Device, Sep. 25, 1985.

Patent Abstracts of Japan, vol. 10, No. 33 (M-452) [2090], Feb. 8, 1986.

European Search Report EP 89 121113 dated Nov. 2, 1990.

*Primary Examiner*—Lowell A. Larson
*Assistant Examiner*—Michael J. McKeon
*Attorney, Agent, or Firm*—Wigman, Cohen, Leitner & Myers

[57] ABSTRACT

An apparatus for making elongated headed workpieces having a conveyor device for successively transporting elongated workpieces such as wire pieces transversely to their longitudinal axes from one treatment station into at least one treatment station and including a guided conveyor belt assembly to which the workpieces may be clamped by their circumferential surfaces. Two sections, running together and side by side, of two conveyor belts are guided in such a manner between the stations that they remain in immovable contact on both sides with the transported workpieces. At least one of the two conveyor belts is a toothed belt in which the gaps between the teeth take up the workpieces singly.

12 Claims, 4 Drawing Sheets

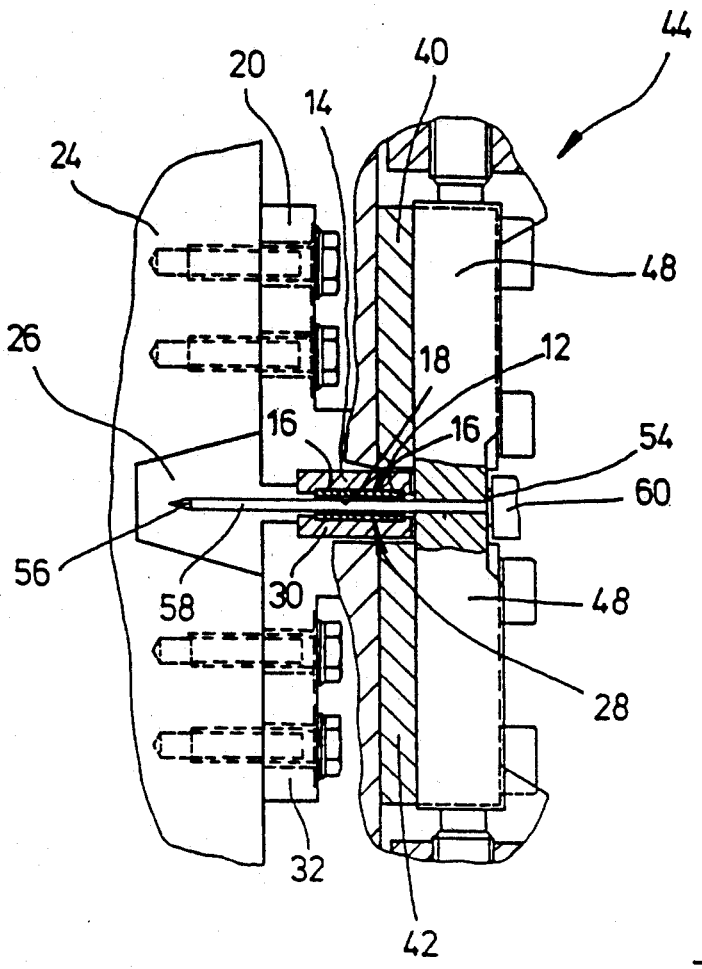
Fig. 2
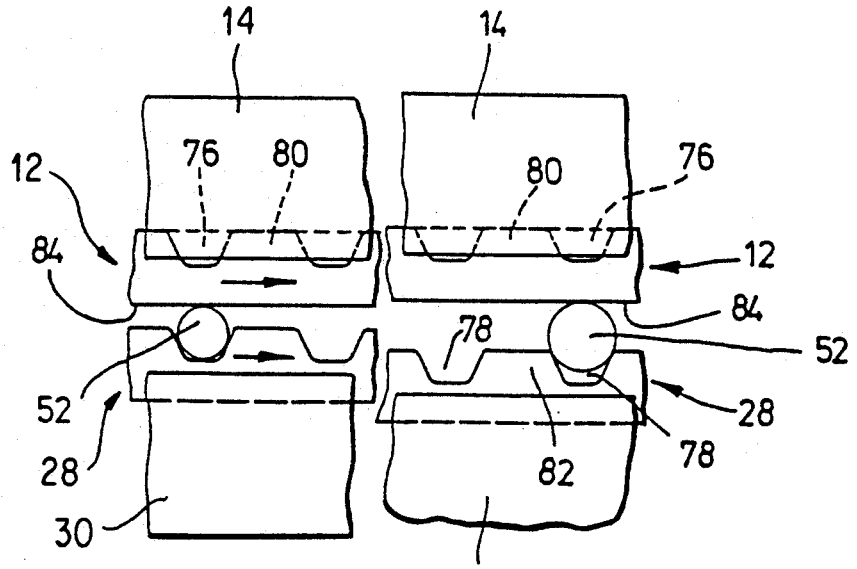
Fig. 6a
Fig. 6b

APPARATUS FOR MAKING AND CONVEYING ELONGATED HEADED WIRE WORKPIECES

This is a continuation of co-pending application Ser. No. 07/535,060 filed on Jun. 8, 1990, now abandoned.

CROSS REFERENCES TO RELATED APPLICATIONS

This application is subject matter related to commonly assigned copending U.S. application Ser. No. 07/535,059 for "Upsetting Device for Upsetting the Ends of Elongated Workpieces such as Wire Pieces and Use of such a Service in a Wire-Working Nail Press," now U.S. Pat. No. 5,088,312.

BACKGROUND OF THE INVENTION

1. Field of the Invention

This invention relates to an apparatus for making elongated headed workpieces including a conveyor device for transporting elongated workpieces and more particularly to wire pieces transported transversely to their longitudinal axes from one treatment station into another.

2. Description of the Prior Art

The state of the art comprises apparatus which include devices for successively transporting several workpieces transversely to their longitudinal axis from one operating station into at least one other operating station by means of a guided conveyor belt to which the workpieces can be clamped by their circumferential surface.

DD-PS 41 141 discloses such a device for bringing nails, wire shanks and the like to processing tools, in particular grinding and polishing tools for removing the burr produced from stamping and perforating the eyelet part. For this purpose, the workpieces are displaced transversely to their longitudinal axis by means of a revolving elastic conveyor belt on which elastic clamping devices having two or more jaws are riveted down at intervals. When the conveyor belt turns around, these clamping devices automatically open and close to take up and deliver the workpieces and clamp them firmly as they move them past the tools. A supply device and an ejector device are used for supplying the workpieces to the clamping devices and emptying the clamping devices. In addition, spring elements are provided to keep the workpieces in the correct operating position during their delivery into the clamping devices.

By means of this known device, the workpieces to be processed can only be moved continuously past the tools for the grinding and polishing process and the elastic conveyor belt yields under the operating pressure exerted on the workpieces by the tools. The device therefore does not provide for accurately positioned and stepwise movement of the parts to the tools. Moreover, the size and shape of the jaws of the clamping device must always be accurately adapted to the diameter of the workpieces.

OBJECTS AND SUMMARY OF THE INVENTION

An object of the present invention is the accurate transport of workpieces of differing cross-sectional profile into a particular position in an operating station of an apparatus for making elongated headed workpieces even at high speeds of transport.

It is an additional object the present invention to provide a conveyor device which is as far as possible universally usable and is so designed that one and the same conveyor means can be used to carry wire pieces within a specified but wide range of diameters and lengths intermittently forwards in rapid succession and accurately positioned and aligned to one or more working stations arranged side by side.

On the basis of an apparatus of the type mentioned above, the invention solves this problem by providing two sections, running together and side by side, of two conveyor belts (12 and 28; 192), which sections are guided in such a manner between the stations that they will remain in immovable contact on both sides with the transported workpieces (52; 186), at least one of the two conveyor belts (12 or 28; 192) being a toothed belt in which the gaps (76 and 78) between the teeth take up the workpieces (52; 186) singly.

The parallel sections of two toothed belts may be so arranged that their teeth face one another, i.e. tooth on tooth, so that the belts revolve as mirror images of one another, or the teeth of either section may be slightly staggered in relation to those of the other section, for example to such an extent that the teeth of one section are in vertical alignment with the gaps between the teeth of the other section. According to one variation, both sections take up the same position as they move along, so that, for example, the teeth of both sections face upwards. The distance between the belts is adjustable in all four cases. The toothed belts are so adjusted in relation to one another that the wire pieces are held firmly clamped by the flanks of the teeth of at least one of the belts while being carried along by both belts. Due to these variations in the arrangements of the toothed belts, wire pieces of all diameters within the operating range of a working or processing machine can be transported rapidly and with positional accuracy by means of only one size of belts.

These advantages enable the conveyor device according to the invention to be used in, for example, an apparatus for the manufacture of precision wire nails having an accurately specified form and size of head on the shanks as is required for further use in automatic nailing machines to ensure trouble-free operation of the latter. The conveyor device could also form part of an apparatus for the production of workpieces which require upsetting operations in several stages, e.g. in multistage presses. In this case, also, the conveyor device functions with such accuracy that the blanks to be worked will remain unmoved in the correct position during their passage through all the forming stations arranged side by side (each with clamping and upsetting device). The device may thus be used wherever accurate, stepwise transport is important.

The present invention thus also relates to the use of a conveyor; device according to the invention in a wire-working machine, in particular a nail press used as apparatus for the manufacture of wire nails, in particular headed nails.

BRIEF DESCRIPTION OF THE DRAWINGS

The invention will now be explained in detail with reference to two preferred embodiments of the device according to the invention and one variation illustrated by way of example in the drawings, in which FIG. 2 is a side view, partially in section, of the first embodiment, FIGS. 3*a* and 3*b* each is an enlarged view of the pair of conveyor belts of FIG. 1, part a of the figure showing the arrangement for a workpiece of relatively small diameter and part b showing the arrangement for a larger workpiece diameter, FIGS. 6*a* and 6*b* show the pair of conveyor belts of the variation of the first embodiment, again for a smaller and a larger workpiece diameter.

DETAILED DESCRIPTION OF THE PREFERRED EMBODIMENT

First Embodiment and Its Variation

Figure 1:
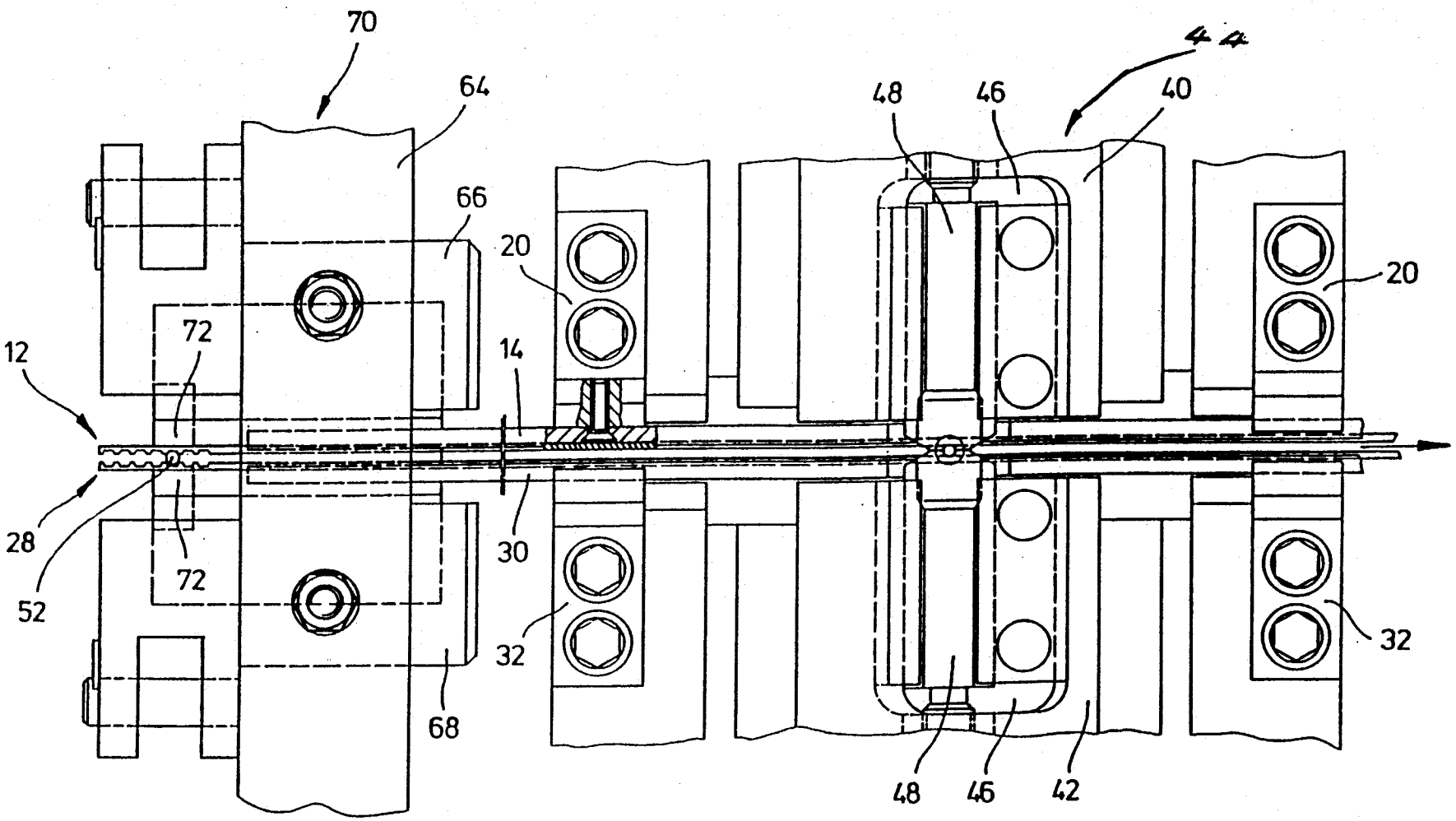
FIG. 1 is a front view, partly broken away, of the first embodiment.

The conveyor belt shown in FIGS. 1 and 2 comprises the lower horizontal section of an endless upper toothed belt (12) supported in an upper horizontal guide (14) having lateral vertical guide surfaces (16) which are slightly more shallow than the distance from the base of the teeth to the back of the belt and an upper guide surface (18) which is equal in width to the belt. The toothed side of the upper toothed belt (12) faces downwards.

The upper guide (14) is firmly screwed into two identical holders (20) which are vertically adjustable in slots and fixed to the machine body (24). The section of toothed belt (12) shown in the figures is deflected upwards by means of several tooth edged and/or smooth edged discs (not shown) arranged at one end of the guide (14) and closely adjacent thereto. The upper horizontal section of a second endless, lower toothed belt (28) forming the other conveyor belt is arranged with its toothed side facing upwards and is supported in a guide (30) identical to the guide (14). This section of belt is deflected downwards. The guide (30) is fixed in holders (32) which are also vertically adjustable.

The endless toothed belts (12 and 28) are driven intermittently, either together by a motor driven stepping gear by way of a gear wheel transmission and the (toothed) deflecting discs or, depending on the desired speed of transport, they may be driven together by a common variable speed servo motor or separately, each by its own variable speed servo motor, both in the same direction of displacement corresponding to the desired direction of transport.

The front parts (40 and 42) of an upper and, respectively, lower lever or carriage of a clamping device (44) constituting, e.g., part of an apparatus for the manufacture of wire nails are arranged halfway between the holders (20 and 32) (FIG. 1). Identical clamping tools (48) in the form of jaws for clamping a wire nail blank (52) are adjustably fixed, one in each tool holder (46) of the front part (40 or 42) of each lever or carriage.

FIG. 2 shows an upsetting tool (60) of an upsetting device constituting part of the above-mentioned apparatus for forming a head (54) on the wire nail blank (52). The upsetting tool (60) is placed centrally in relation to the pair of toothed belts (12, 28) in a position in front of the clamping tools (48). The machine body (24) has a trapezoidal groove (26) extending over the whole length of the path of transport to provide space for the passage of the nail blanks (52) and finished wire nails (58).

In the lefthand part of FIG. 1, two levers (66 and 68) of a wire cutting device (70) of the apparatus for the manufacture of wire nails are pivotally mounted in a common bearing (64). The levers (66) and (68) have each a tool holder with identical cutting tool (72) for cutting off a given length of wire and forming a pyramidal tip on the resulting nail blank (52).

The two guides (14 and 30) end at a short distance to the right and in front of the cutting tools (72) while the lower and upper section, respectively, of the toothed belts (12 and 28) extend slightly beyond the cutting tools (72) before being deflected upwards or downwards, respectively. The length of the guides (14 and 30) on the righthand side of the apparatus in FIG. 1 depends on the number of working stations arranged side by side for the clamping and upsetting operations and on the arrangement provided for removing the finished nails.

If the conveyor device forms part of the apparatus for the manufacture of wire nails indicated in FIGS. 1, 2, 3*a*, 3*b*, 4*a*, 4*b*, 5*a*, 5*b*, 6*a* and 6*b* of the drawing, the mode of operation is as follows:

A take-in device known per se but not illustrated here draws the wire from the wire supply through a straightening apparatus and pushes the quantity of wire required for the desired length of nail shank and for forming the nail head through the open cutting tools (72) and between the lower and upper section, respectively, of the toothed belts (12 and 28) (in a direction intersecting the plane of the drawing, in FIG. 1). The cooperating cutting tools (72) moving in opposite directions now sever the wire by a rocking movement of the cutting levers (66 and 68) in such a manner as to form a pyramidal tip (56) to the wire nail. While the wire is being pushed in between the two sections of toothed belts and cut off, the intermittent drive to the pair of toothed belts (12, 28) is at a standstill. The intermittent drive is thereafter briefly switched on again and the pair of toothed belts (12, 28) is moved onwards, for example by four teeth in the example given here, and then stopped again for a fresh intake of wire. This process is repeated until a measured length of nail blank (52) comes to lie between the clamping jaws (48) of the clamping device (44).

Figures 3A, 3B:
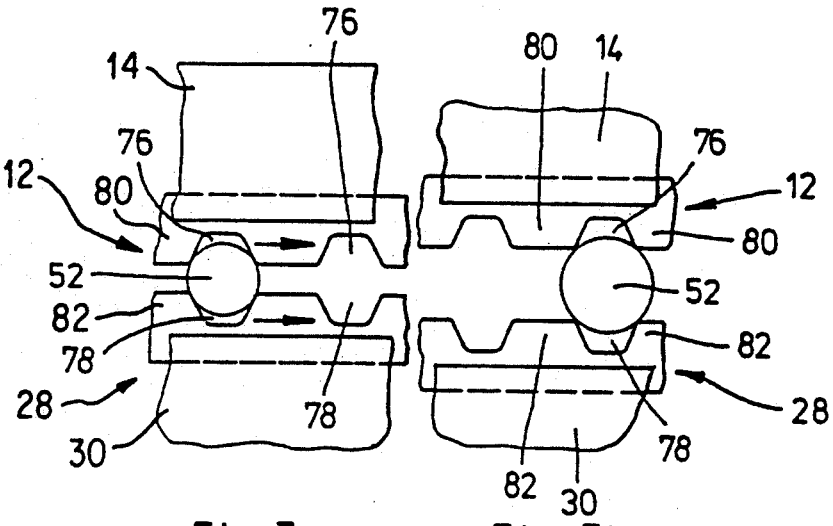
Figures 4A, 4B:
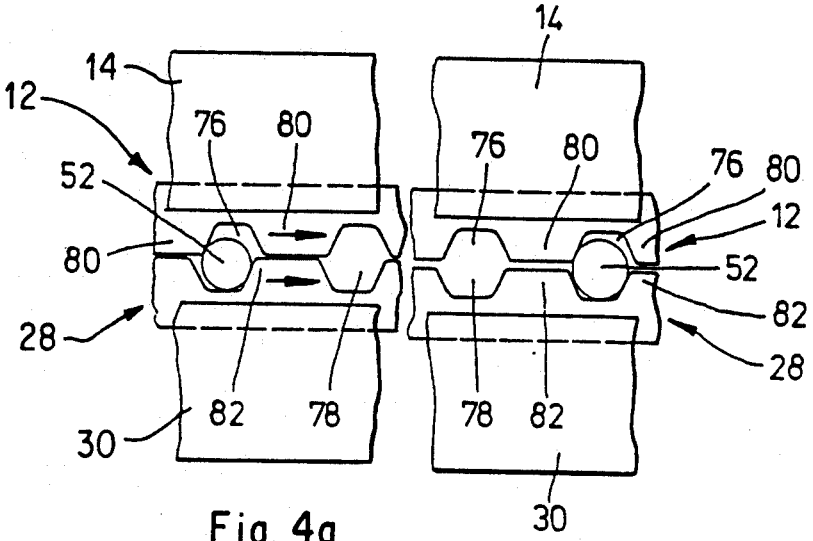
FIGS. 4*a* and 4*b* show the pair of conveyor belts of FIGS. 3*a* and 3*b*, again for a smaller and a larger workpiece diameter but operating differently.
Figures 5A, 5B:
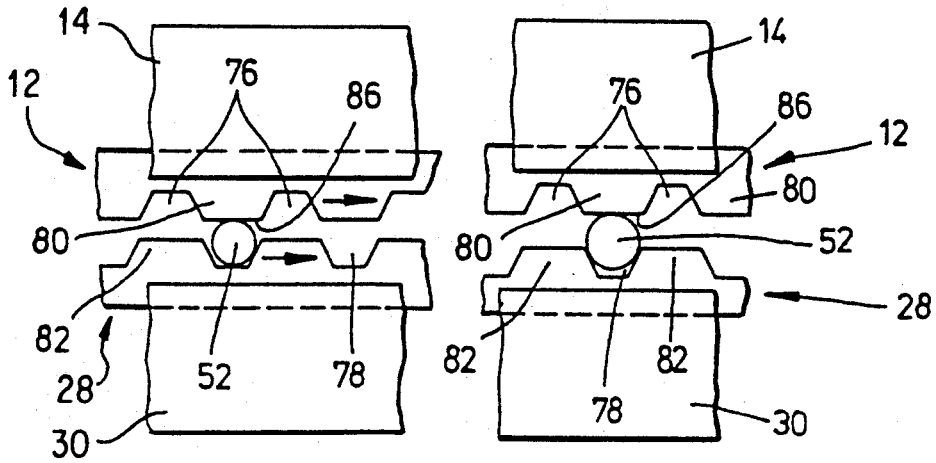
FIGS. 5*a* and 5*b* shows the pair of conveyor belts of FIGS. 3*a* and 3*b* in a third mode of operation, again for a smaller and a larger, workpiece diameter.

The wire which is to be cut to the required length may then be introduced, as shown in FIGS. 3*a*, 3*b*, 4*a* or 4*b*, into the gaps (76 and 78) between the teeth (80 and 82) facing one another on the toothed belts (12 and 28). Alternatively, as shown in FIGS. 5*a* and 5*b*, it may be introduced into a gap (78) between two teeth of the upper section of the lower toothed belt (28) to bear against the top (86) of a tooth (80) on the section of the upper toothed belt (12), or it may be introduced into a gap (78) between two teeth on the section of the lower belt (28) to bear against the back (84) of the section of the upper toothed belt (12) (FIGS. 6*a* and 6*b*), depending on the relative longitudinal positions of the two toothed belts (12 and 28). If nails having a different diameter of wire are to be manufactured and transported, all that is necessary is to alter the distance between the two parallel sections of belts by moving the holders (20 and 32) towards or away from one another. The guides, (14 and 30) are moved at the same time; see FIGS. 3*a*, 3*b*, 4*a*, 4*b*, 5*a*, 5*b*, 6*a* and 6*b*. If the change in diameter of the wire exceeds the amount by which the distance between the belts can be altered as shown in FIGS. 3*a* and 3*b*, the toothed side of the upper belt (12) is turned upwards so that the teeth (80 and 82) of both belts (12 and 28) face ,in the same direction, namely upwards (FIGS. 6*a* and 6*b*). This arrangement enables nails with an even smaller diameter of wire to be securely transported. Wires of about the same diameter as those shown in the arrangement of FIGS. 6*a* and 6*b* may also be securely transported by the arrangement of FIGS. 4*a* and 4*b*, in which the teeth (80) and tooth gaps (76) of the upper toothed belt (12) are always shifted by a certain amount in the direction of transport in relation to the teeth (82) and tooth gaps (78) of the lower toothed belt (28) as they are driven intermittently forwards, the upper teeth and gaps in the present example racing ahead of the teeth and gaps of the lower belt. The nail blanks (52) are thereby pressed against the right flanks of the teeth (82) of the section of lower belt (28) by the left flanks of the teeth (80) of the section of upper belt (12) and thus clamped securely while being carried forwards stepwise.

The turning over of the toothed belt (12) may be omitted if the arrangement of FIGS. 5*a* and 5*b* is employed so that the teeth (80) of the upper toothed belt (12) race ahead of the teeth (82) of the lower toothed belt (28) to such an extent that the teeth (80) of the upper belt (12) are in vertical alignment with the gaps (78) between the teeth of the lower belt (28). In that case, the tops (86) of the teeth (80) of the upper toothed belt (12) press the nail blanks (52) against the adjacent flanks of the teeth (82) of the lower toothed belt (28).

In the embodiment according to FIGS. 3*a* and 3*b*, the nail blanks (52) are clamped between two adjacent flanks of teeth (80 and 82) of both toothed belts (12 and 28).

In the embodiment according to FIGS. 6*a* and 6*b*, the back (84) of the upper toothed belt (12) presses the nail blank (52) against adjacent flanks of the teeth (82) of the lower toothed belt (28).

In all four modes of transport mentioned above, the adjustable contact pressure of the guide rails (14 and 30) assists in fixing the nail blanks (52) in position during their stepwise transport. Further, the lateral guide surfaces (16) of the guides (14 and 30) prevent the toothed belts (12 and 28) from shifting sideways as they are carried along their path.

As already mentioned, the nail blanks (52), guided with precision and firmly held as they are transported stepwise, enter the gaps between the clamping tools (48) of the clamping device (44) with a short end of wire required for forming the nail head (54) projecting from the clamping tools (48), to the right in FIG. 2. The clamping tools (48) then close up and hold the nail blank (52) firmly until the upsetting tool (60) has formed the head (54), the clamping tools serving as anvil for this operation. When the clamping tools (48) have opened again and the upsetting tool (60) has taken up its rearward position, the completed nail (58) is moved a step forwards, away from the region of the tools, while a new blank enters between the tools (48, 60) and the process begins again from the beginning. After a few transport phases, the completed nails (58) are safely discharged over a chute at the end of the straight path of transport without the aid of an additional ejector device or, alternatively, the row of completed nails arriving at the end of the path may be mechanically removed one by one and carried away for storage or some other process.

Additional clamping and upsetting devices could be arranged side by side between the clamping and upsetting device and the point of discharge of the completed nail, as already mentioned, if the wire blanks are required to be subjected to the upsetting operation in several stages.

It should also be mentioned that up to 800 nails per minute can be produced with the conveyor device according to the invention operating in conjunction with the apparatus for the manufacture of wire nails, i.e. the frequency of transport may be 13 per second.

Second Embodiment

Figure 7:
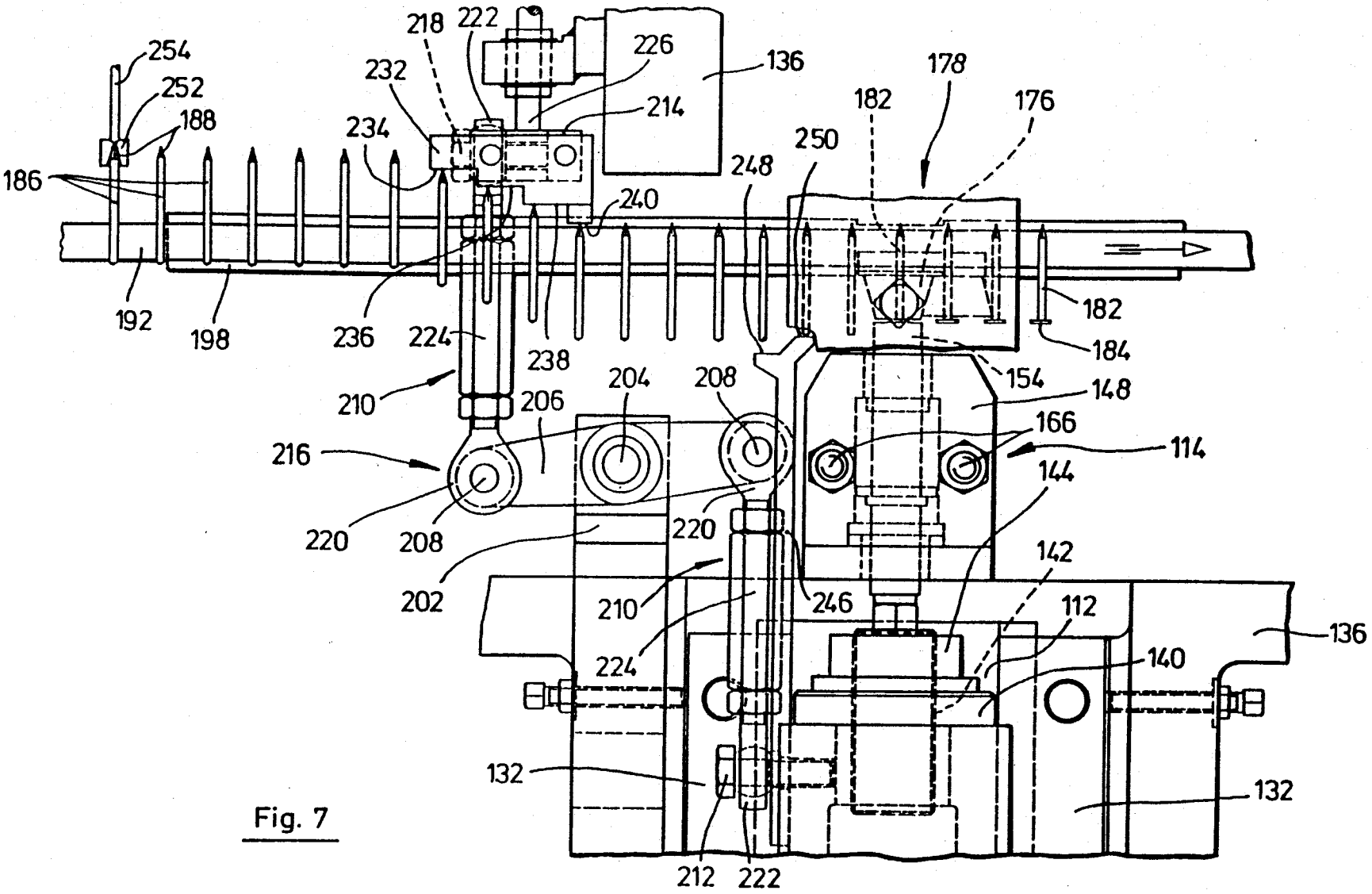
FIG. 7 is a top plan view, partly broken away, of the second embodiment.

In FIG. 7, a carriage (112) of an upsetting device (114) forming part of an apparatus for the manufacture of wire nails (182) is connected to a connecting rod link by means of a pin seated in the forked end (not shown) of the carriage (112). This connecting rod link is held on a short-stroke crank pin of a drive shaft of the apparatus by means of a connecting rod cap. The carriage (112), shown in its forward operating position in FIG. 7, has a dovetail guide over its whole length and is mounted to be slidably guided between two guide bars (132) on a baseplate in the machine frame (136). An internally threaded flange (140) is fixed to the end of the carriage (112) shown in the drawing and engages with an adjustment screw (142) which is secured by a ring nut (144).

A compression spring-loaded upsetting tool (154) of the upsetting device (114) is slidably guided to be longitudinally displaceable in bearing bushes in a separate guide (148) in the axial extension of the adjustment screw (142).

The guide (148) with the floatingly mounted upsetting tool (154) is fixed to the machine frame (136) by means of two stud bolts (166) so as to be easily removable and exchangeable. The upsetting tool (154) is continuously kept in positive contact with the hexagon head of the adjustment screw (142) by means of a return spring. Situated in the axial extension of the upsetting tool (154), immediately in front of the latter and placed symmetrically with respect to its axis, are two clamping tools (176) of a clamping device (178) of the apparatus for the manufacture of wire nails (182). These clamping tools (176) cooperatively move in opposite directions and each is seated in a lever or carriage. FIG. 7 shows a wire nail (182) with upset head (184) firmly clamped between the clamping tools (176). The shank of wire nail (182) projecting from the clamping tools (176) in FIG. 7 is firmly clamped in the gaps between adjacent teeth of two toothed belts serving as conveyor belts of a conveyor device which is shown in the upper part of FIG. 7 and constitutes part of the apparatus for the manufacture of wire nails. The two toothed belts, of which only the lower belt (192) may be seen in the drawing, move the nail blanks (186) which as yet have no head (184) intermittently towards and away from a position which is exactly central in both the horizontal and the vertical plane in front of the upsetting tool (154) of the upsetting device (114). This is brought about by a stepwise movement of the belts (e.g. 192) transversely to the direction of upsetting and clamping of the upsetting and clamping device (114, 178). The distance between the toothed belts and hence the tension with which the nail blanks (186) are held in the gaps between the teeth can be adjusted by means of two vertically adjustable guide rails, one for each belt. Only the lower guide rail (198) is shown in the drawing. The lateral guide surfaces of the guide rails (e.g. 198) prevent sideways displacement of the toothed belts as they move along their path of transport.

In FIG. 7, a bearing (202) in which a rocking lever (206) is mounted on pin(s) (204) is fixed to the front part of the guide for the carriage (112). Each arm of this lever (206) is acted upon by a connecting rod (210) by way of a pin (208). One of these rods (210) connects one end of the rocking lever (206) to the carriage (112) of the upsetting device (114) by means of a pin (212) while the other connecting rod (210) connects the other end of the rocking lever to a tool holder (214) of a positioning device (216) for the nail blanks (186) by means of pin(s) (218). Each of the connecting rods (210) has two joint heads (220, 222) connected together by a tension lock (224).

The tool holder (214) is supported to be longitudinally displaceable in the machine frame (136) by two rods (226) placed one below the other. The holder (214) carries a positioning tool (232) which has four working surfaces (234 to 240) for a 4-stage positioning process during which the longitudinal position of the nail blanks (186) can be altered.

An additional positioning tool (246) longitudinally displaceable in a slot is clamped to the carriage (112) by means of the pin (212) which also fixes the joint head (222). This positioning tool (246) has only two working surfaces (248 and 250) for axially displacing the nail blanks (186) in a direction opposite to that in which the first positioning tool (232) displaces the blanks.

The lower of two cutting tools (252) of a wire cutting device acting against one another for cutting lengths of wire (254) and forming pyramidal tips to the wire blanks (186) is indicated at the very lefthand end of FIG. 7 as part of the apparatus for producing wire nails.

The mode of operation of the conveyor device described above is as follows when it forms part of an apparatus for the manufacture of wire nails illustrated in part in FIG. 7:

A take-in device known per se but not illustrated here draws the wire (254) from the wire supply through a straightening apparatus and pushes the quantity of wire required for the desired length of nail shank and for forming the nail head (184) through the opened cutting tools (252) and into the gaps between the teeth of two toothed belts (e.g. 192). The cooperating cutting tools (252) moving in opposite directions, each of which may be mounted in a lever or in a carriage, now sever the wire (254) in such a manner as to form a pyramidal tip (188) to the wire nail. While the wire (254) is being pushed in between the two toothed belts and cut off, the intermittent drive to the pair of toothed belts is briefly at a standstill. Thereafter, the drive is briefly switched on again, whereby the pair of toothed belts is moved forwards by one step, and the drive is stopped again before a fresh length of wire is fed forwards (a stepping mechanism could be used for this alternating stopping and starting). This process is repeated until a cut length of nail blank (186) lies between the clamping tools (176) of the clamping device (178) and centrally in front of the upsetting tool (154) of the upsetting device (114).

In order that the apparatus may be suitable for producing nails over a wide range of lengths without major conversion work in spite of the fact that the cutting tools (252) of the cutting device and the clamping and upsetting device (178, 114) of the apparatus for producing wire nails (182) are fixed in position, the difference in the distance between the tip (188) of a wire nail and the upsetting tool (154) when producing nails of a different length is compensated for by displacing the nail blanks (186) in their longitudinal direction within the conveyor path between the cutting station and the station for forming the head by upsetting. This is carried out as follows:

The nail blanks (186) are positioned by the two positioning tools (232 and 246) of the positioning device (216), the first tool (232) having four working surfaces (234 to 240) for pushing the nails forward stepwise. This stepwise positioning takes place with each forward stroke of the carriage (112). During the forward movement of the carriage (112), i.e. during the formation of each nail head (184), the positioning tool (232) which is supported in the machine frame (136) is moved towards the conveyor device by way of the connecting rod (210) and the rocking lever (206) so that the nail blank (186) which at that moment is in front of the first working surface (234) of the positioning tool (232) is pushed forwards by a certain amount. As already mentioned, the conveyor device is at a standstill at this stage. While the carriage (112) is moving backwards, the drive is briefly switched on for a period of transport so that the nail blank (186) which has previously been pushed forwards by the working surface (234) of the tool (232) is now brought in front of the second working surface (236) and is pushed forwards by the same amount during a fresh upsetting operation. These movements are repeated until the nail blank (186) has been pushed into its furthest forward position by the fourth working surface (240) of the positioning tool (232). When the nail blank (186) is in this longitudinal position, it is carried stepwise in the direction towards the upsetting station until it lies in front of the working surface (250) of the second positioning tool (246). The nail blank (186) may now if necessary be moved slightly backwards by the working surface (250) to compensate for tolerances in the lengths of the blanks so that the blank can take up its final position. This movement is also derived from the upsetting movement of the carriage (112) and, in the example illustrated here, the nail blank is brought into such a position between the clamping tools (176) after two phases of transport that the length of wire projecting from the clamping jaws (176) is exactly the amount required for forming the head (184) of the wire nail. If the nail blanks (186) are exceptionally long, their displacement backwards by the second positioning tool (246) takes place in two stages, the blanks being first moved back by the working surface (248) and thereafter into their final position by the working surface (250).

The positioning device (216) may obviously be omitted altogether when only nails of one length are to be produced or when great accuracy in the length of the nails is not required. In such cases, the cutting device is so arranged that when the nail blanks (186) are placed in the conveyor device, the length of wire projecting from the clamping tools (176) is exactly that required for producing the head of the nail by the upsetting process.

When the clamping jaws (176) close up, they firmly hold the blank (186) in position for the upsetting process which now follows for producing the head (184) of the nail. For this purpose, the drive shaft is set in motion to impart a reciprocating movement to the carriage (112). The upsetting tool (154), which is connected non-positively to the hexagon head of the adjustment screw (142) by the return spring, participates in this reciprocating movement and with each forward movement it produces a head (184) on a nail blank (186), the clamping tools (176) serving as anvil for this operation. With each backward movement of the carriage (112), the compression spring relaxes and pushes the upsetting tool (154) backwards so that the latter remains in permanent frictional contact with the adjustment screw (142). The magnitude of the upsetting pressure (and hence also the form of the nail head) may be adjusted by turning the adjustment screw (142) in the threaded flange (140) of the carriage (112) by varying amounts.

One complete wire nail (182) is moved out of the range of the tools with each transport step while a fresh nail blank (186) arrives between the tools (154 and 176) and the process then begins again from the beginning. After several transport phases, the completed nails (182) are safely discharged over a chute at the end of the conveyor path without the aid of a special ejector device, or alternatively, the completed nails arriving in a row may be automatically removed singly and carried away for storage or some further process.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An apparatus for making headed elongated fasteners such as nails from elongated workpieces such as wire pieces, comprising at least two workpiece stations including a station having means for deforming an end of each said workpiece so as to form a fastener head, a guided conveyor belt assembly to which each workpiece may be clamped by its circumferential surface, wherein said conveyor belt assembly comprises two facing conveyor belts each having a back, which belts are guided in such a manner between the stations that they remain in immovable contact with the workpieces being transported; wherein at least one of the two conveyor belts is toothed having gaps between teeth, in which toothed belt each gap between two teeth may receive only one single workpiece; and wherein each said toothed conveyor belt is arranged with the teeth thereof facing in the same direction so as to engage the workpiece between a tooth gap of one belt and the back of the facing belt.

2. An apparatus for making headed elongated fasteners such as nails from elongated workpieces each having a longitudinal axis, such as wire pieces, comprising:

a plurality of treatment stations including a station having a means for deforming an end of each said workpiece so as to form a fastener head, a conveyor device for successively transporting said elongated workpieces such as wire pieces transversely to their longitudinal axes from one treatment station into at least one other treatment station, including:

a guided conveyor belt assembly to which the workpieces may be clamped by their circumferential surfaces;

said conveyor belt assembly comprising two facing conveyor belts;

which belts are guided in such a manner between the stations that the belts remain on opposing sides of the workpieces in immovable contact with the workpieces being transported; and wherein each of the two conveyor belts is a toothed belt having alternating teeth and gaps in which each of the gaps between teeth is adapted to receive a single workpiece selected from a specified range of diameters and lengths and to accurately position, align and carry each said workpiece intermittently forward in rapid succession, said belts holding each said workpiece in immovable contact in a direction transverse to a longitudinal direction parallel to said longitudinal axes and adapted to permit movement of each said workpiece in said longitudinal direction; and means for displacing said wire pieces along the longitudinal axes thereof while gripped by said conveyor belt assembly.

3. An apparatus for making headed elongated fasteners such as nails from elongated workpieces each having a longitudinal axis, such as wire pieces, comprising:

a plurality of treatment stations including a station having a means for deforming an end of each said workpiece so as to form a fastener head, a conveyor device for successively transporting said elongated workpieces such as wire pieces transversely to their longitudinal axis from one treatment station into at least one other treatment station, including:

a guided conveyor belt assembly to which the workpieces may be clamped by their circumferential surfaces;

said conveyor belt assembly comprising two facing conveyor belts;

which belts are guided in such a manner between the stations that the belts remain on opposing sides of the workpieces in immovable contact with the workpieces being transported; and means for displacing said wire pieces along the longitudinal axes thereof while gripped by said conveyor belt assembly;

wherein each of the two conveyor belts is a toothed belt having a profile of alternating teeth and gaps in which each of the gaps between teeth is adapted to receive a single workpiece selected from a specified range of diameters and lengths and to accurately position, align and carry each said workpiece intermittently forward in rapid succession, said belts holding each said workpiece in immovable contact in a direction transverse to a longitudinal direction parallel to said longitudinal axes and adapted to permit movement of each said workpiece in said longitudinal direction, the teeth of said two conveyor belts arranged to face as mirror images of one another with respect to a transport surface formed by the moving longitudinal axes of the clamped workpieces.

4. An apparatus for making headed elongated fasteners such as nails from elongated workpieces each having a longitudinal axis, such as wire pieces, comprising:

a plurality of treatment stations including a station having a means for deforming an end of each said workpiece so as to form a fastener head, a conveyor device for successively transporting said elongated workpieces such as wire pieces in a transport direction transversely to their longitudinal axes from one treatment station into at least one other treatment station, including:

a guided conveyor belt assembly to which the workpieces may be clamped by their circumferential surfaces;

said conveyor belt assembly comprising two facing conveyor belts;

which belts are guided in such a manner between the stations that the belts remain on opposing sides of the workpieces in immovable contact with the workpieces being transported; and wherein each of the two conveyor belts is a toothed belt having a profile of alternating teeth and gaps arranged in a row in which each of the gaps between teeth is adapted to receive a single workpiece selected from a specified range of diameters and lengths and to accurately position, align and carry each said workpiece intermittently forward in rapid succession, each said tooth having a top surface, said belts holding each said workpiece in immovable contact in a direction transverse to a longitudinal direction parallel to said longitudinal axes and adapted to permit movement of each said workpiece in said longitudinal direction, the belts arranged with the teeth of said two conveyor belts facing towards each other but shifted in relation to one another in the direction of transport so that the two rows of teeth clamp the workpieces by means of a gap between two teeth of one belt and the top surface of the facing belt.

5. The headed fastener-making apparatus according to claim 4, each conveyor belt further comprising a toothed front and a back, wherein between two adjacent stations each conveyor belt engages in a three-sided guide of a section of said conveyor belt transporting the workpieces; and wherein the toothed front of one conveyor belt section is exposed and is opposite to the toothed front of the other conveyor belt section.

6. The headed fastener-making apparatus according to claim 5, further comprising guides in the form of rails arranged to be adjustable in at least one of the two transverse directions perpendicular to a direction of transport but in any case perpendicularly to the longitudinal axes of the workpieces.

7. An apparatus for making headed elongated fasteners such as nails from elongated workpieces each having a longitudinal axis, such as wire pieces, comprising:

a plurality of treatment stations including a station having a means for deforming an end of each said workpiece so as to form a fastener head, a conveyor device for successively transporting said elongated workpieces such as wire pieces transversely to their longitudinal axes from one treatment station into at least one other treatment station, including:

a guided conveyor belt assembly to which the workpieces may be clamped by their circumferential surfaces;

said conveyor belt assembly comprising two facing conveyor belts for transporting said workpieces and a pair of three-sided guides, each said guide engaging a section of a belt;

which belts are guided in such a manner between the stations that the belts remain on opposing sides of the workpieces in immovable contact with the workpieces being transported; and wherein each of the two conveyor belts is a toothed belt having a profile of alternating teeth and gaps in which each of the gaps between teeth is adapted to receive a single workpiece selected from a specified range of diameters and lengths and to accurately position, align and carry each said workpiece intermittently forward in rapid succession, said belts holding each said workpiece in immovable contact in a direction transverse to a longitudinal direction parallel to said longitudinal axes and adapted to permit movement of each said workpiece in said longitudinal direction, each conveyor belt further comprising a toothed front and a back, said three-sided guides engaging said toothed fronts and said backs of said belts such that one of a toothed front and a back of one belt is exposed to a toothed front of the facing belt.

8. The headed fastener-making apparatus according to claim 7, further comprising guides in the form of rails arranged to be adjustable in at least one of the two transverse directions perpendicular to a direction of transport but in any case perpendicularly to the longitudinal axes of the workpieces.

9. An apparatus for making headed elongated fasteners such as nails from elongated workpieces each having a longitudinal axis, such as wire pieces, comprising:

a plurality of treatment stations including a station having a means for deforming an end of each said workpiece so as to form a fastener head, a conveyor device for successively transporting said elongated workpieces such as wire pieces transversely to their longitudinal axes from one treatment station into at least one other treatment station, including:

a guided conveyor belt assembly to which the workpieces may be clamped by their circumferential surfaces;

said conveyor belt assembly comprising two facing conveyor belts for transporting said workpieces and a pair of three-sided guides, each said guide engaging a section of a belt;

which belts are guided in such a manner between the stations that the belts remain on opposing sides of the workpieces in immovable contact with the workpieces being transported; and wherein each of the two conveyor belts is a toothed belt having a profile of alternating teeth and gaps in which each of the gaps between teeth is adapted to receive a single workpiece selected from a specified range of diameters and lengths and to accurately position, align and carry each said workpiece intermittently forward in rapid succession, said belts holding each said workpiece in immovable contact in a direction transverse to a longitudinal direction parallel to said longitudinal axes and adapted to permit movement of each said workpiece in said longitudinal direction, with the teeth of said conveyor belts arranged to face as mirror images of one another with respect to a transport surface formed by the moving longitudinal axes of the clamped workpieces, each conveyor belt further comprising a toothed front and a back wherein between two adjacent stations, each toothed belt engages one of said three-sided guides of the sections transporting the workpieces, and wherein the teeth of one belt are exposed to the teeth of the facing belt.

10. The headed fastener-making apparatus according to claim 9, further comprising guides in the form of rails arranged to be adjustable in at least one of the two transverse directions perpendicular to a direction of transport but in any case perpendicularly to the longitudinal axes of the workpieces.

11. An apparatus for making headed elongated fasteners such as nails from elongated workpieces each having a longitudinal axis, such as wire pieces, comprising:

a plurality of treatment stations including a station having a means for deforming an end of each said workpiece so as to form a fastener head, a conveyor device for successively transporting said elongated workpieces such as wire pieces transversely to their longitudinal axes from one treatment station into at least one other treatment station, including:

a guided conveyor belt assembly to which the workpieces may be clamped by their circumferential surfaces;

said conveyor belt assembly comprising two facing conveyor belts;

which belts are guided in such a manner between the stations that the belts remain on opposing sides of the workpieces in immovable contact with the workpieces being transported; and wherein each of the two conveyor belts is a toothed belt having a profile of alternating teeth and gaps in which each of the gaps between teeth is adapted to receive a single workpiece selected from a specified range of diameters and lengths and to accurately position, align and carry each said workpiece intermittently forward in rapid succession, said belts holding each said workpiece in immovable contact in a direction transverse to a longitudinal direction parallel to said longitudinal axes and adapted to permit movement of each said workpiece in said longitudinal direction, said belts arranged with the teeth of said conveyor belts facing in the same direction.

12. An apparatus for making headed elongated fasteners such as nails from elongated workpieces each having a longitudinal axis, such as wire pieces, comprising:

a plurality of treatment stations including a station having a means for deforming an end of each said workpiece so as to form a fastener head, a conveyor device for successively transporting said elongated workpieces such as wire pieces in a transport direction transversely to their longitudinal axes from one treatment station into at least one other treatment station, including:

a guided conveyor belt assembly to which the workpieces may be clamped by their circumferential surfaces;

said conveyor belt assembly comprising two facing conveyor belts;

which belts are guided in such a manner between the stations that the belts remain on opposing sides of the workpieces in immovable contact with the workpieces being transported; and wherein each of the two conveyor belts is a toothed belt having a profile of alternating teeth and gaps arranged in a row in which each of the gaps between teeth is adapted to receive a single workpiece selected from a specified range of diameters and lengths and to accurately position, align and carry each said workpiece intermittently forward in rapid succession, each said tooth having a flank, said belts holding each said workpiece in immovable contact in a direction transverse to a longitudinal direction parallel to said longitudinal axes and adapted to permit movement of each said workpiece in said longitudinal direction, said belts arranged so that the teeth of said two conveyor belts are facing towards each other but shifted in relation to one another in the direction of transport so that the two rows of teeth clamp the workpieces by means of two tooth flanks of one belt and a surface of the facing belt, respectively.

* * * * *